US005973282A

United States Patent [19]

Takemori et al.

[11] Patent Number: 5,973,282

[45] **Date of Patent: *Oct. 26, 1999**

[54] SHEET-SHAPED SWITCH

[75] Inventors: Satoru Takemori; Ryuichi Hagiya; Naoki Yamada, all of Fukushima-ken, Japan

[73] Assignee: Alps Electric Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/726,448

[22] Filed: Oct. 4, 1996

[30] Foreign Application Priority Data

Oct. 13, 1995 [JP] Japan ..... 7-292033

[51] Int. Cl.[6] ..... H01H 1/10

[52] U.S. Cl. ..... 200/512; 200/514

[58] Field of Search ..... 200/512, 514, 200/520, 341, 344

[56] References Cited

U.S. PATENT DOCUMENTS 4,701,579 10/1987 Kurachi et al. ..... 200/512

FOREIGN PATENT DOCUMENTS 3-296017 12/1991 Japan .

*Primary Examiner*—David J. Walczak

*Attorney, Agent, or Firm*—Brinks Hofer Gilson & Lione

[57] ABSTRACT

A sheet-shaped switch including a first insulating sheet having a plurality of fixed electrodes formed on an upper surface thereof, a second insulating sheet having movable electrodes which are formed on a lower surface thereof such that the movable electrodes are opposed to the fixed electrodes, and an insulating spacer sandwiched between the upper surface of the first insulating sheet and the lower surface of the second insulating sheet, the insulating spacer defining through-holes which are aligned with the fixed electrodes and the movable electrodes such that each fixed electrode is able to contact an associated movable electrode through one of the through-holes. Protrusions in the form of elongated ridges are disposed between the first insulating sheet and the insulating spacer and/or between the second insulating sheet and the insulating spacer, and are formed around the through holes within 5 mm of the through holes. The protrusions facilitate a thinner switch by allowing the insulating spacer to be 75 $\mu$m or less.

15 Claims, 4 Drawing Sheets

SHEET-SHAPED SWITCH

BACKGROUND OF THE INVENTION

1. Field of the Invention

The present invention relates to a sheet-shaped switch suitable for use in a keyboard switch or the like, and particularly to a thin sheet-shaped switch.

2. Description of the Related Art

A conventional sheet-like or -shaped switch has been formed thick and at high cost, because first and second insulating sheets on which fixed electrodes and movable electrodes constituting the sheet-shaped switch are respectively printed, and an insulating spacer disposed between the insulating sheets are sufficiently thick.

The conventional sheet-shaped switch will now be described below with reference to FIGS. 8 and 9. A first insulating sheet 1 is formed of an insulating material such as a polyester film. The thickness of the first insulating sheet 1 ranges from about 100 $\mu$m to 200 $\mu$m, for example. A plurality of fixed electrodes 2 each composed of a conductive material such as a single layer of a mixture of silver and carbon and first electrode patterns 4 each composed of the same material as that for each fixed electrode 2 are formed on the upper surface of the first insulating sheet 1 by printing. The thickness of each of the fixed electrodes 2 and the first electrode patterns 4 ranges from 5 $\mu$m to 25 $\mu$m.

An insulating spacer 5 is opposed to the first insulating sheet 1 and disposed above the first insulating sheet 1. The insulating spacer 5 has penetrations or through holes which are provided at positions opposed to the fixed electrodes 2 respectively and have sizes which are sufficiently large such that movable electrodes 8 to be described later can be respectively brought into contact with the fixed electrodes 2. Incidentally, the thickness of the insulating spacer 5 ranges from about 100 $\mu$m to 200 $\mu$m, for example.

A second insulating sheet 7 is composed of an insulating material such as a polyester film. The thickness of the second insulating sheet 7 ranges from about 100 $\mu$m to 200 $\mu$m, for example. For example, an alphabetical letter or numerical character (not shown) indicative of each switch position is printed on the upper surface of the second insulating sheet 7 or a keytop portion (drive portion) of an unillustrated keyboard switch is disposed on the upper surface thereof. A plurality of movable electrodes 8 each composed of a conductive material such as a single layer of a mixture of silver and carbon, and a plurality of second electrode patterns 10 each composed of the same conductive material as each movable electrode 8 are formed on the lower surface of the second insulating sheet 7 by printing. Incidentally, the thickness of each of the movable electrodes 7 and the second electrode patterns 10 ranges from 5 $\mu$m to 25 $\mu$m.

The first insulating sheet 1, the insulating spacer 5 and the second insulating sheet 7 are mutually multilayered as shown in FIG. 9. When the electrodes 2 and 8 are disposed so as to be opposed in upward and downward directions within each through hole 6 of the insulating spacer 5 by such a multilayer construction and the electrodes 8 are depressed by the operation of an unillustrated key, the movable electrodes 8 printed on the second insulating sheet 7 are brought into contact with their corresponding fixed electrodes 2. On the other hand, when the depressing force is eliminated, the movable electrodes 8 are restored to their original states by an elastic restoring force of the second insulating sheet 7.

In the sheet-shaped switch having such a structure, a space or interval defined between each fixed electrode 2 and each movable electrode 8 is held by the thickness of the insulating spacer 5 itself. This interval provides a withstand voltage between the fixed electrode 2 and the movable electrode 8. It is therefore necessary to make the insulating spacer 5 thick. Further, when one attempts to increase the withstand voltage, a thicker material is necessary as the insulating spacer 5 correspondingly, whereby a material cost becomes high.

Since the first insulating sheet 1, the insulating spacer 5 and the second insulating sheet 7 respectively use the same material and are formed to the same thickness up to now from the viewpoint of easiness on the fabrication of the sheet-shaped switch, management of the manufacturing process, maintenance, etc., the cost of materials for the sheet-shaped switch becomes high and the sheet-shaped switch is still made thick.

SUMMARY OF THE INVENTION

With the foregoing in view, it is an object of the present invention to provide a sheet-shaped switch which is thin in thickness, low in cost and stably operated.

According to one aspect of the present invention, for achieving the above object, there is provided a sheet-shaped switch comprising a first insulating sheet having a plurality of fixed electrodes formed on an upper surface thereof, a second insulating sheet having a plurality of movable electrodes opposed to the fixed electrodes, which are formed on a lower surface of the second insulating sheet, an insulating spacer layered between the upper surface of the first insulating sheet and the lower surface of the second insulating sheet and having through holes, which are defined in portions where the fixed electrodes and the movable electrodes are opposed to each other, so that the fixed electrodes are able to contact with the movable electrodes respectively, and protrusions disposed between the first insulating sheet and the insulating spacer and/or between the second insulating sheet and the insulating spacer and in the vicinity of the through holes.

The protrusions are preferably formed on the same surface of the insulating sheet, on which the fixed electrodes and/or the movable electrodes are formed.

The protrusions are preferably formed on one surface or both surfaces of the insulating spacer.

Preferably, each of the protrusions is made of the same material as that for the fixed electrodes and/or the movable electrodes and is formed to the same thickness as that for each of the fixed electrodes and/or the movable electrodes.

The protrusions preferably comprise first protrusions and second protrusions respectively formed so as to be superimposed on the first protrusions.

Each protrusion is preferably shaped in the form of a circle, a circular ring, a circular arc, an ellipse or a rectangle.

A space or interval between each of the fixed electrodes on the first insulating sheet and each of the movable electrodes on the second insulating sheet can be sufficiently ensured by each of the protrusions disposed between the first insulating sheet and the insulating spacer and/or between the second insulating sheet and the insulating spacer and in the vicinity of the through holes defined in the insulating spacer.

The protrusions disposed between the first insulating sheet and the insulating spacer and/or between the second insulating sheet and the insulating spacer and in the vicinity of the through holes defined in the insulating spacer are respectively formed on the same surfaces of the first insulating sheet and/or the second insulating sheet, on which the fixed electrodes of the first insulating sheet and/or the movable electrodes of the second insulating sheet are formed. Thus, the number of manufacturing process steps can be reduced.

A space or interval between each of the fixed electrodes of the first insulating sheet and each of the movable electrodes of the second insulating sheet can be sufficiently ensured by disposing the first and second protrusions between the first insulating sheet and the insulating spacer and/or between the second insulating sheet and the insulating spacer.

The above and other objects, features and advantages of the present invention will become apparent from the following description and the appended claims, taken in conjunction with the accompanying drawings in which a preferred embodiment of the present invention is shown by way of illustrative example.

BRIEF DESCRIPTION OF THE DRAWINGS

The present invention will now be described with reference to the accompanying drawings in which.

DESCRIPTION OF THE PREFERRED EMBODIMENTS

Figure 1:
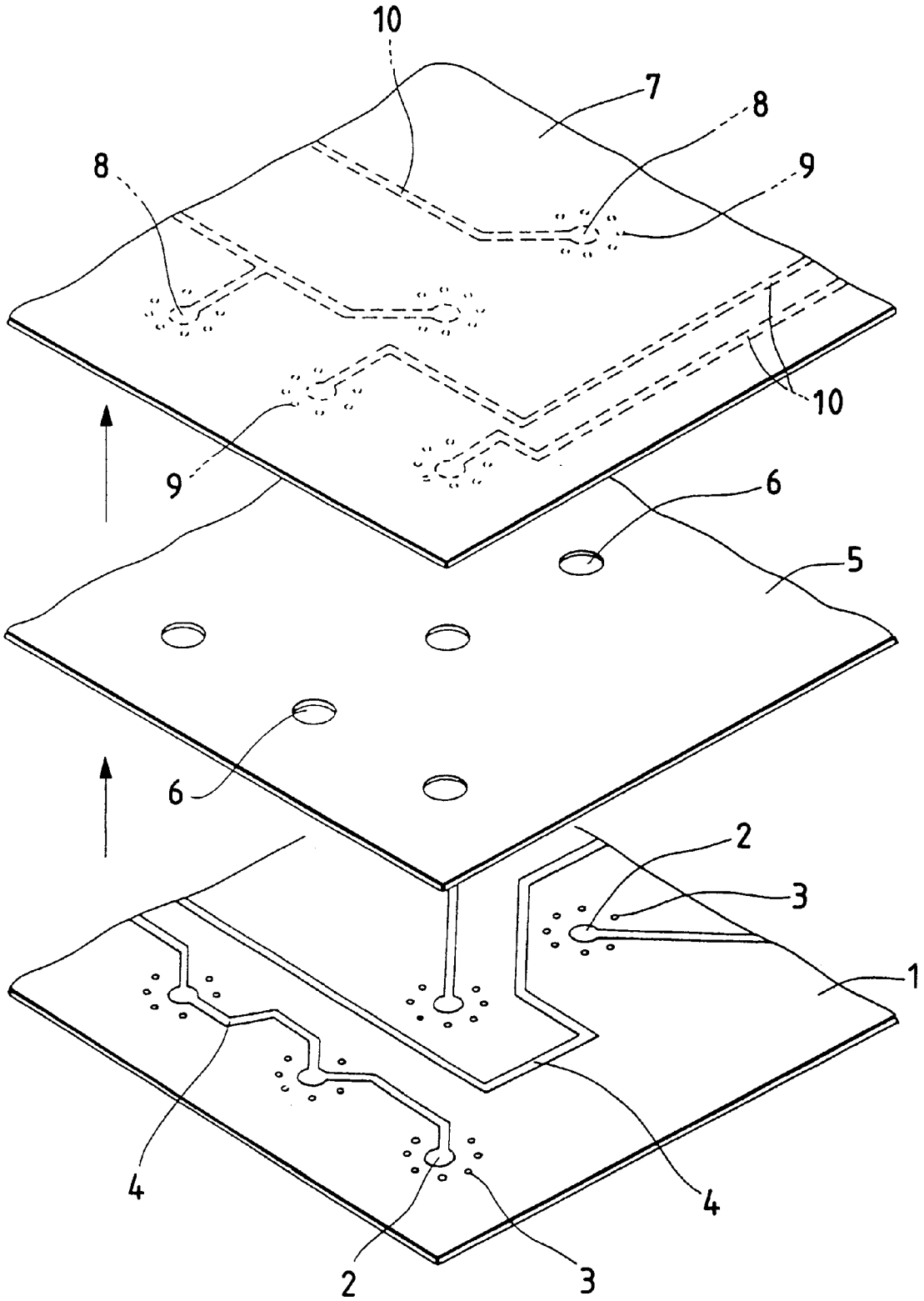
FIG. 1 is an exploded perspective view showing one embodiment of a sheet-shaped switch of the present invention.

One embodiment of a sheet-like or -shaped switch according to the present invention will hereinafter be described in detail with reference to FIGS. 1 through 6. Incidentally, the same elements of structure as employed in the conventional example are identified by the same reference numerals.

A first insulating sheet 1 is composed of an insulating material having flexibility such as a polyester film and has a thickness of about 75 μm. A plurality of fixed electrodes 2 each composed of a conductive material such as a single silver layer, a single layer of a mixture of silver and carbon or a plurality of layers each composed of silver and carbon, a plurality of circular lugs or protrusions 3 each composed of the same conductive material as the fixed electrodes 2 and provided so as to surround each fixed electrode 2, and first electrode patterns 4 each composed of the same conductive material as the fixed electrodes 2 are formed on the upper surface of the first insulating sheet 1 by screen printing. Incidentally, the fixed electrodes 2, the circular protrusions 3 and the first electrode patterns 4 are formed in thicknesses ranging from 5 μm to 25 μm.

The circular protrusions 3 are respectively disposed at equal intervals around equal as seen from the center of each fixed electrode 2.

An insulating spacer 5 is disposed above the first insulating sheet 1 in an opposing relationship to the first insulating sheet 1. The insulating spacer 5 has circular penetration or through holes 6 defined therein at positions opposed to the fixed electrodes 2 respectively. The through holes 6 are respectively formed in sizes which are sufficiently large such that movable electrodes 8 to be described later can be brought contact with the fixed electrodes 2 inside the through holes 6 respectively. Incidentally, the thickness of the insulating spacer 5 is about 75 μm.

A second insulating sheet 7 is composed of an insulating material such as a polyester film. The thickness of the second insulating sheet 7 is about 75 μm. For example, an alphabetical letter or numerical character (not shown) indicative of each switch position is printed on the upper surface of the second insulating sheet 7 or a keytop portion (drive portion) of an unillustrated keyboard switch is disposed on the upper surface thereof. A plurality of movable electrodes 8 each composed of a conductive material such as a single silver layer, a single layer of a mixture of silver and carbon or a plurality of layers each composed of silver and carbon, a plurality of circular protrusions 9 each composed of the same conductive material as each movable electrode 8, and second electrode patterns 10 each composed of the same conductive material as each movable electrode 8 are formed on the lower surface of the second insulating sheet 7 by printing. Incidentally, the thickness of each of the movable electrodes 8, the circular protrusions 9 and the second electrode patterns 10 ranges from 5 μm to 25 μm.

The circular protrusions 9 are respectively disposed at intervals equal as seen from the center of each movable electrode 8.

Since the electrodes 2 and 8 and protrusions 3 and 9 each composed of the conductive material such as a single silver layer, a single layer of a mixture of silver and carbon or a plurality of layers each composed of silver and carbon, and the electrode patterns 4 and 10 are respectively formed of the same material, processes for effecting printing on the respective insulating sheets 1 and 7 are performed by one process.

Figure 3:
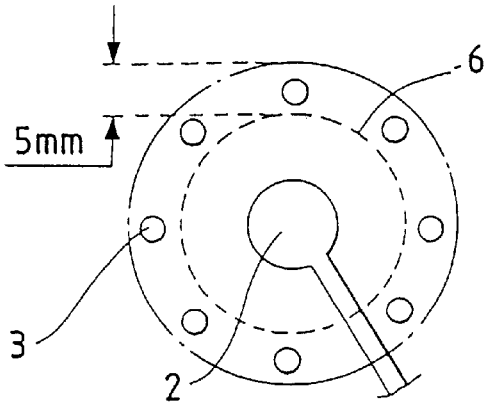
FIG. 3 is a fragmentary plan view illustrating one example of protrusions formed in the switch portion of the sheet-shaped switch shown in FIG. 1.

As shown in FIG. 3, each protrusion 3 (protrusion 9) is formed at a position adjacent to each circular through hole 6 of the insulating spacer 5. The protrusions 3 are disposed outwardly of the through hole 6 and within 5 mm on one side.

Figure 2:
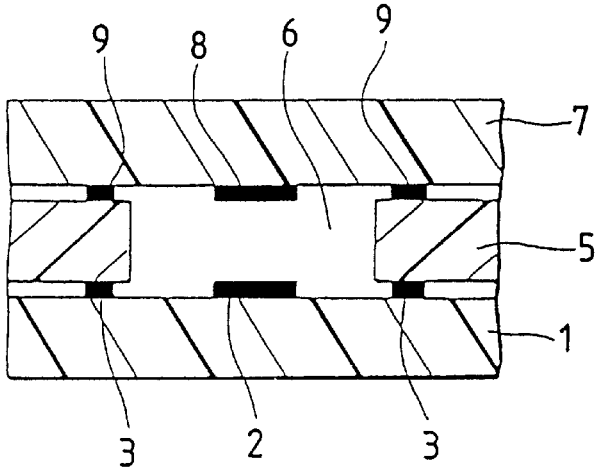
FIG. 2 is a fragmentary cross-sectional view showing one example of a switch portion of the sheetshaped switch shown in FIG. 1.

Further, the first insulating sheet 1, the insulating spacer 5 and the second insulating sheet 7 are mutually layered as shown in FIG. 2. Thus, the electrodes 2 of the insulating sheet 1 are respectively vertically opposed to the electrodes 8 of the insulating sheet 7 within the through holes 6 of the insulating spacer 5. Further, when the movable electrodes 8 are depressed by the operation of an unillustrated key, they are brought into contact with their corresponding fixed electrodes 2 so that the sheet-shaped switch is turned on owing to such contact. If the depressing force is eliminated, then each movable electrode 8 is restored to its previous or original state by an elastic restoring force of the second insulating sheet 7. Accordingly, the sheet-shaped switch is brought into an off state owing to the restoring of each movable electrode 8 to its original state in this way.

When the thickness of the insulating spacer 5 is set to 75 μm, the thickness of each of the electrodes 2 and 8 is set to 25 μm and the thickness of each protrusion 3 or 9 is set to 25 μm in the sheet-shaped switch formed as described above, the interval or space between the movable electrode 8 and the fixed electrode 2 becomes 50 μm when the protrusions are formed on one insulating sheet alone, whereas the space therebetween becomes 75 μm when the protrusions are formed on both insulating sheets. Thus, the space between the electrodes can be sufficiently ensured even in the case of the sheet-shaped switch using the insulating spacer 5 having the thickness of 75 μm.

Since the interval between the electrodes can be sufficiently ensured, the restoring force (displacement) of the second insulating sheet 7 having flexibility can be also ensured.

Figure 5:
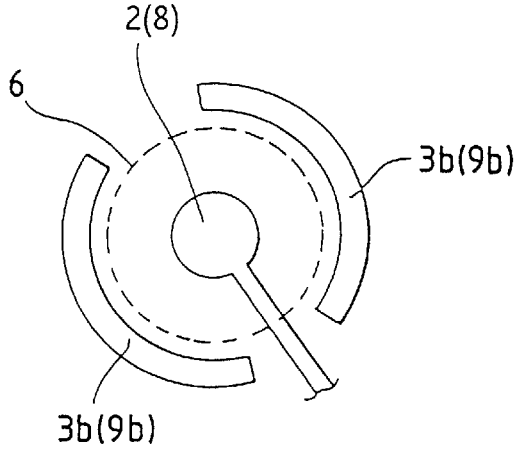
FIG. 5 is a fragmentary plan view showing a further example of protrusions formed in the switch portion of the sheet-shaped switch shown in FIG. 1.
Figure 6:
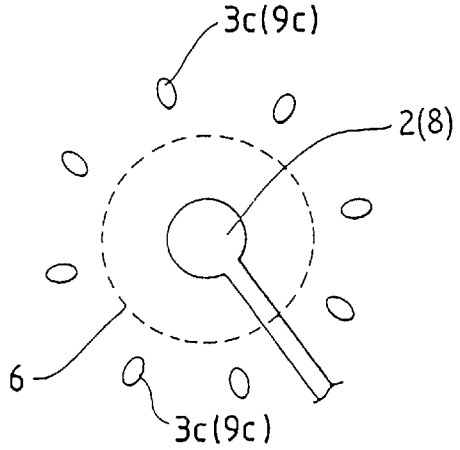
FIG. 6 is a fragmentary plan view depicting a still further example of protrusions formed in the switch portion of the sheet-shaped switch shown in FIG. 1.

Another example of the protrusions 3 will now be described with reference to FIGS. 4 through 6.

Figure 4:
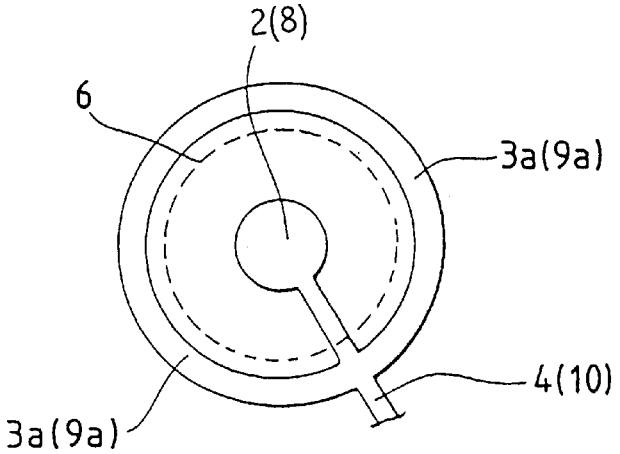
FIG. 4 is a fragmentary plan view depicting another example of a protrusion formed in the switch portion of the sheet-shaped switch shown in FIG. 1.

Referring first to FIG. 4, a protrusion 3*a* (and/or protrusion 9*a*) is annularly formed as an elongated ridge with an electrode 2 as the center and has a location connected to an electrode pattern 4 which leads out from the electrode 2. Referring next to FIG. 5, each of protrusions 3*b* (and/or protrusion 9*b*) is shaped in the form of an arc with an electrode 2 as the center and has no location connected to an electrode pattern 4 which leads out from the electrode 2. Protrusions 3*c* (and/or protrusion 9*b*) shown in FIG. 6 are respectively shaped in the form of a plurality of ellipses with an electrode 2 defined as the center. Although not shown in the drawing, the protrusions may be rectangular as their shapes in place of the above shapes. Further, the protrusions are not necessarily limited to these and may be formed in desired shapes.

The protrusions 3*a* and 3*b* (see FIGS. 4 and 5) experience high switch-on loads and are thick enough to prevent conduction caused, for example, by vibrations. It is further preferable that in order to increase the switch-on loads, the number of the protrusions 3 (see FIG. 3) and the number of the protrusions 3*c* (see FIG. 6) are increased to six or more and the protrusions 3 and 3*c* are respectively disposed in the vicinity of the electrodes 2.

Figure 7:
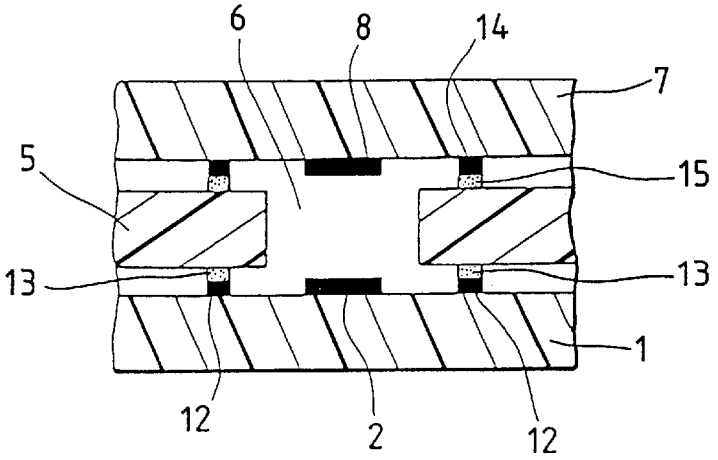
FIG. 7 is a fragmentary cross-sectional view showing another example of the switch portion of the sheet-shaped switch shown in FIG. 1.
Figure 8:
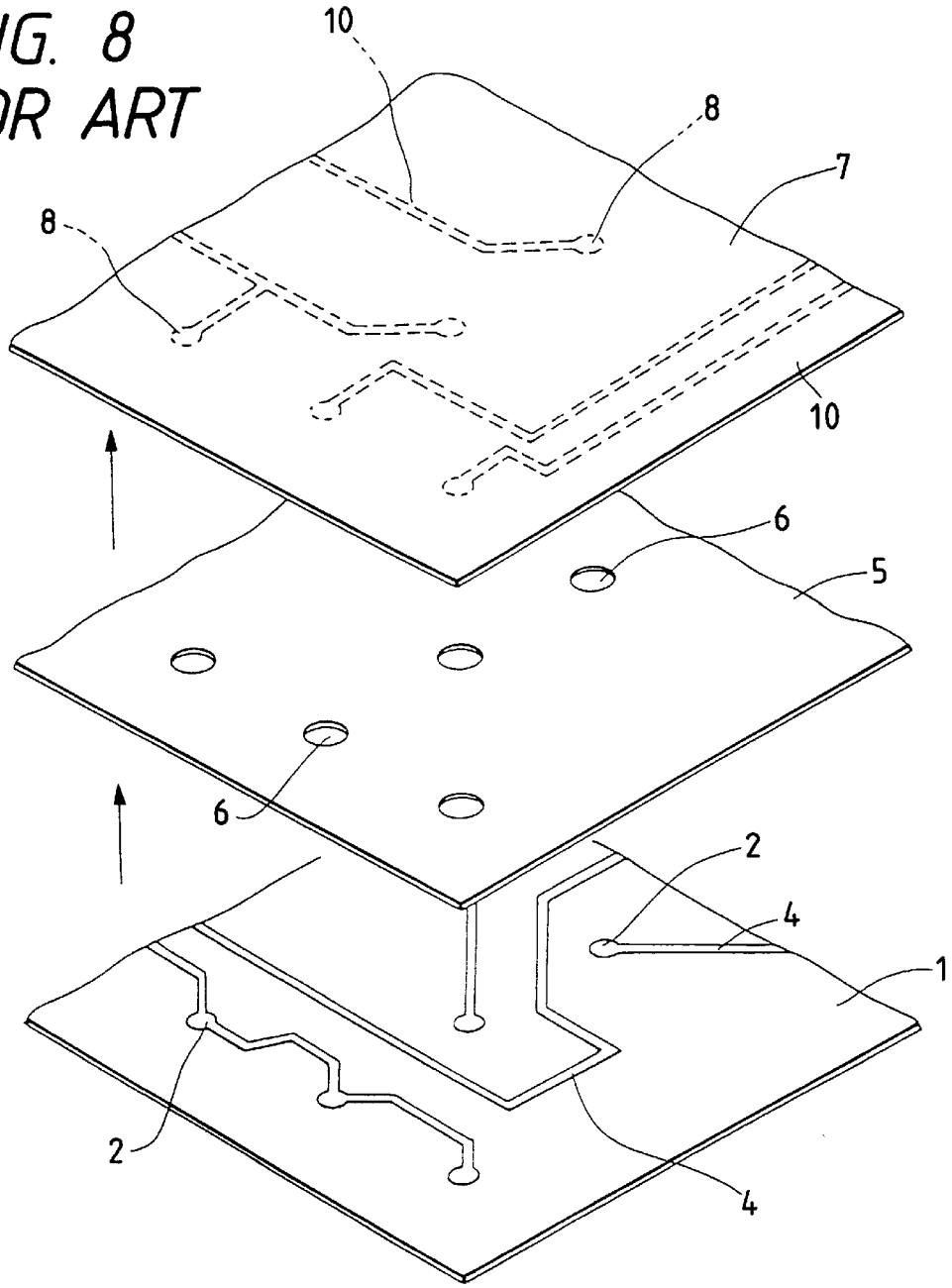
FIG. 8 PRIOR ART
FIG. 8 is a fragmentary exploded perspective view illustrating a conventional sheet-shaped switch.
Figure 9:
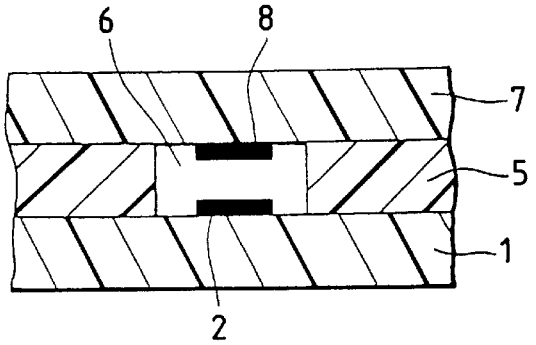
FIG. 9 PRIOR ART
FIG. 9 is a fragmentary cross-sectional view depicting a switch portion of the conventional sheetshaped switch shown in FIG. 8.

FIG. 7 shows another embodiment of a sheet-shaped switch of the present invention. In FIG. 7, the same elements of structure as those employed in the first embodiment are identified by the same reference numerals and their detailed description will be omitted.

The sheet-shaped switch comprises a first insulating sheet 1 having a plurality of fixed electrodes 2 formed on the upper surface thereof, a second insulating sheet 7 having movable electrodes 8 formed on the lower surface thereof, which are respectively opposed to the fixed electrodes 2 and capable of being brought into contact with and separated from the fixed electrodes 2, and an insulating spacer 5 which is contactably layered between the upper surface of the first insulating sheet 1 and the lower surface of the second insulating sheet 7 and has through holes 6 which are defined in portions at which the fixed electrodes 2 and the movable electrodes 8 are opposed to each other, so that the fixed electrodes 2 can be brought into contact with the movable electrodes 8.

In a manner similar to the above-described embodiment, protrusions are formed between the first insulating sheet 1 and the insulating spacer 5 and/or between the second insulating sheet 7 and the insulating spacer 5 and in the vicinity of the through holes 6. Each protrusion comprises a first protrusion 12 (14) and a second protrusion 13 (15). The second protrusion 13 (15) is formed on the first protrusion 12 (14) by overprinting. A material used for the second protrusion 13 (15) may be the same conductive material as the first protrusion 12 (14) or may be selected from other conductive materials or other insulating materials.

The first protrusion 12 is formed to the same thickness as the thicknesses of the electrodes 2 and 8 by printing simultaneously with the electrodes 2 and 8. Thereafter, the second protrusion 13 is formed by printing.

Owing to the above construction, the sheetshaped switch whose cost is low and having an excellent withstand voltage, can be provided.

Further, the second protrusion 13 can be formed into a desired shape according to the shape of the first protrusion 12.

According to the present invention, as has been described above, the protrusions are disposed between the first insulating sheet and the insulating spacer and/or between the second insulating sheet and the insulating spacer and in the vicinity of the through holes defined in the insulating spacer. Therefore, a sufficient interval or space between electrodes (contacts) can be stably maintained (withstand voltage can be held) even when the insulating sheets and the insulating spacer are thin in thickness. Since the present invention can use the first insulating sheet 1, the insulating spacer 5 and the second insulating sheet 7 all of which are made with the same material and identical (thin) in thickness, material cost becomes low. Thus, a sheet-shaped switch can be formed thinly and at low cost.

According to the present invention as well, the protrusions are disposed between the first insulating sheet and the insulating spacer and/or between the second insulating sheet and the insulating spacer. Further, the protrusions are formed at positions adjacent to the through holes defined in the insulating spacer. Therefore, a sufficient interval or space between electrodes can be stably maintained even when the insulating sheets and the insulating spacer are thin in thickness. Accordingly, an advantageous effect can be brought about in that a switching operation can be stably held even by a sheet-shaped switch which is formed thin and at low cost.

Further, according to the present invention, the protrusions are disposed between the first insulating sheet and the insulating spacer and/or between the second insulating sheet and the insulating spacer. In addition, the protrusions are formed of the same materials as the fixed electrodes and/or the movable electrodes and to the same thicknesses as those of the fixed electrodes and/or the movable electrodes. By doing so, the electrodes and the protrusions can be formed simultaneously in the same process. Accordingly, an advantageous effect can be brought about in that a sheet-shaped switch which is formed thin and at low cost, can be provided.

Furthermore, according to the present invention, the first protrusions and the second protrusions are disposed between the first insulating sheet and the insulating spacer and/or between the second insulating sheet and the insulating spacer. Therefore, a more sufficient interval or space between electrodes can be maintained as compared with the formation of the first protrusions alone even when the insulating sheets and the insulating spacer are thin in thickness. Accordingly, an advantageous effect can be brought about in that a withstand voltage can be stably held even by a sheet-shaped switch which is formed thinly and at low cost.

Still further, according to the present invention, the protrusions are disposed between the first insulating sheet and the insulating spacer and/or between the second insulating sheet and the insulating spacer. The protrusions are formed in positions in the vicinity of the through holes defined in the insulating spacer and the protrusions are shaped in the form of a circle, a circular ring, a circular arc, an ellipse or a rectangle. Therefore, an advantageous effect can be brought about in that the degree of freedom of design can be enhanced. Further, an advantageous effect can be brought about in that the shapes of the protrusions become effective in maintaining an interval between electrodes as the area of the entire each protrusion increases.

Having now fully described the invention, it will be apparent to those skilled in the art that many changes and modifications can be made without departing from the spirit or scope of the invention as set forth herein.

What is claimed is:

1. A sheet-shaped switch comprising:

a first insulating sheet having a plurality of fixed electrodes formed on an upper surface thereof;

a second insulating sheet having movable electrodes opposed to the fixed electrodes, said movable electrodes being formed on a lower surface of said second insulating sheet;

an insulating spacer sheet sandwiched between the upper surface of said first insulating sheet and the lower surface of said second insulating sheet, the insulating spacer sheet defining through holes which are aligned with said fixed electrodes and said movable electrodes such that each of said fixed electrodes is able to contact one of said movable electrodes through one of said through holes; and protrusions disposed between said first insulating sheet and said insulating spacer sheet and/or between said second insulating sheet and said insulating spacer sheet;

wherein each of said protrusions is associated with one of said through holes, said protrusions having an inside perimeter such that said inside perimeter is disposed less than 5 mm and greater than 1 mm from an edge of said associated through hole;

wherein said protrusions is formed as an elongated ridge; and wherein said first and second insulating sheets and said insulating spacer sheet have a thickness of 75 $\mu$m or less.

2. A sheet-shaped switch as claimed in claim 1, wherein said protrusions are formed on the upper and/or lower surfaces of the first and second insulating sheets, respectively, with the fixed electrodes and/or the movable electrodes.

3. A sheet-shaped switch as claimed in claim 1, wherein said protrusions are formed on at least one of an upper surface and a lower surface of said insulating spacer.

4. A sheet-shaped switch as claimed in claim 1;

wherein said each protrusion is composed of the same material as that used to form the fixed electrodes and/or the movable electrodes, and is formed to have the same thickness as that of each of the fixed electrodes and/or the movable electrodes.

5. A sheet-shaped switch as claimed in claim 1, wherein said protrusions comprise first protrusions and second protrusions respectively formed such that the second protrusions are superimposed on the first protrusions.

6. A sheet-shaped switch according to claim 1, wherein all of said first and second insulating sheets and said insulating spacer are formed from a common material having a common thickness.

7. A sheet shaped switch comprising:

a first insulating sheet having a plurality of fixed electrodes formed on an upper surface thereof, said electrodes having a first thickness;

a second insulating sheet having movable electrodes opposed to the fixed electrodes, said movable electrodes being formed on a lower surface of said second sheet, said movable electrodes having said first thickness;

an insulating spacer sheet sandwiched between the upper surface of said first insulating sheet and the lower surface of said second insulating sheet, said insulating spacer sheet defining through holes which are aligned with said fixed electrodes and said movable electrodes such that each of said fixed electrodes is able to contact one of said movable electrodes through one of said through holes;

a plurality of lower protrusions disposed between said first insulating sheet and said insulating spacer sheet, said lower protrusions having a second thickness, different than said first thickness; and a plurality of upper protrusions disposed between said second insulating sheet and said insulating spacer sheet, said upper protrusions having a third thickness, different than said first thickness.

8. The sheet shaped switch of claim 7, wherein each of said lower protrusions is associated with one of said through holes, said lower protrusions comprising an inner wall such that said inner wall is positioned 5 mm or less and 1 mm or more from an edge of said associated through hole.

9. The sheet shaped switch of claim 7, wherein each of said upper protrusions is associated with one of said through holes, said upper protrusions comprising an inside wall such that said inside wall is positioned 5 mm or less and 1 mm or more from an edge of said associated through hole.

10. The sheet shaped switch of claim 7, wherein said second thickness is greater than the first thickness.

11. The sheet shaped switch of claim 7, wherein said third thickness is greater than the first thickness.

12. The sheet shaped switch of claim 7, wherein said lower protrusions comprise a plurality of lower layers such that each of said lower layers is composed of the same material.

13. The sheet shaped switch of claim 7, wherein said lower protrusions comprise a plurality of lower layers such that said lower layers are composed of different materials.

14. The sheet shaped switch of claim 7, wherein said upper protrusions comprise a plurality of upper layers such that each of said upper layers is composed of the same material.

15. The sheet shaped switch of claim 7, wherein said upper protrusions comprise a plurality of upper layers such that said upper layers are composed of different materials.

* * * * *